US010938111B2

(12) United States Patent
Cuseo et al.

(10) Patent No.: US 10,938,111 B2
(45) Date of Patent: Mar. 2, 2021

(54) ELECTRONIC DEVICE WITH ANTENNA FEED BOLT

(71) Applicant: Apple Inc., Cupertino, CA (US)

(72) Inventors: James M. Cuseo, Cupertino, CA (US); David C. Parell, Sunnyvale, CA (US); Jerzy S. Guterman, San Jose, CA (US); Joel D. Barrera, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 102 days.

(21) Appl. No.: 16/269,203

(22) Filed: Feb. 6, 2019

(65) Prior Publication Data

US 2019/0245270 A1 Aug. 8, 2019

Related U.S. Application Data

(60) Provisional application No. 62/627,582, filed on Feb. 7, 2018.

(51) Int. Cl.

| | |
|---|---|
| ***H01Q 13/08*** | (2006.01) |
| ***H01Q 9/04*** | (2006.01) |
| ***H01Q 13/10*** | (2006.01) |

(52) U.S. Cl.

CPC ..... *H01Q 13/085* (2013.01); *H01Q 9/0457* (2013.01); *H01Q 13/106* (2013.01)

(58) Field of Classification Search

CPC .... H01Q 13/10; H01Q 13/103; H01Q 13/106; H01Q 13/18; H01Q 9/0407; H01Q 9/0435; H01Q 9/0442; H01Q 9/045; H01Q 1/243; H01Q 1/50; H01Q 13/06; H01Q 13/085; H01Q 1/48; H01Q 9/0457; H04B 1/0064; H04B 1/3888; H04B 1/40

See application file for complete search history.

(56) References Cited

U.S. PATENT DOCUMENTS

| | | | | |
|---|---|---|---|---|
| 6,861,928 | B2 | 3/2005 | Okazaki et al. | |
| 6,903,687 | B1 | 6/2005 | Fink et al. | |
| 7,306,475 | B2 | 12/2007 | Tsuruta | |
| 8,836,587 | B2 * | 9/2014 | Darnell ..... | H05K 1/028 343/702 |

(Continued)

*Primary Examiner* — Haissa Philogene

(74) *Attorney, Agent, or Firm* — Treyz Law Group, P.C.; G. Victor Treyz; Matthew R. Williams

(57) ABSTRACT

An electronic device may have metal structures such as metal electronic device housing structures and other conductive structures. The conductive structures may have a slot or other opening. An antenna may be formed from the conductive structures. Control circuitry in the electronic device may receive input from input-output devices and may use the input-output devices to provide a user with output. The control circuitry may be coupled to a radio-frequency transceiver that is used to transmit and receive wireless communications. The radio-frequency transceiver may be coupled to the antenna using a transmission line. The transmission line may have a radio-frequency connector that is coupled to a radio-frequency connector on an antenna feed bolt. The antenna feed bolt may have a shaft that spans the opening in the conductive structures and may be coupled to antenna feed terminals on opposing sides of the opening. The antenna may have a tuning bolt.

20 Claims, 7 Drawing Sheets

(56) References Cited

U.S. PATENT DOCUMENTS

| | | | | |
|---|---|---|---|---|
| 8,970,446 | B2 * | 3/2015 | Pascolini | H01Q 1/2258 343/878 |
| 9,065,175 | B2 * | 6/2015 | Corbin | H05K 1/0215 |
| 9,065,178 | B2 * | 6/2015 | Gyenes | H01Q 1/36 |
| 9,287,627 | B2 * | 3/2016 | Jarvis | H01Q 1/243 |
| 9,496,596 | B2 | 11/2016 | Chirila | |
| 9,559,425 | B2 * | 1/2017 | Zhu | G01V 3/00 |
| 9,577,318 | B2 * | 2/2017 | Pascolini | H01Q 9/0421 |
| 9,627,769 | B2 * | 4/2017 | Koo | H01Q 1/2266 |
| 10,249,937 | B2 * | 4/2019 | Jin | H01Q 5/328 |
| 10,367,570 | B2 * | 7/2019 | Zhou | H04B 7/02 |
| 2005/0146475 | A1 * | 7/2005 | Bettner | H01Q 1/2266 343/767 |
| 2009/0140937 | A1 * | 6/2009 | Chow | H01Q 13/10 343/702 |
| 2019/0296442 | A1 * | 9/2019 | Barrera | H01Q 13/10 |

* cited by examiner

ELECTRONIC DEVICE WITH ANTENNA FEED BOLT

This application claims the benefit of provisional patent application No. 62/627,582, filed Feb. 7, 2018, which is hereby incorporated by reference herein in its entirety.

FIELD

This relates to electronic devices, and more particularly, to feeding antennas in electronic devices that have wireless communications circuitry.

BACKGROUND

Electronic devices are often provided with wireless communications capabilities. Antennas are used to transmit and receive radio-frequency communications signals. Antennas are coupled to radio-frequency transceiver circuitry using transmission lines. Using an antenna feed coupled to a transmission line, the radio-frequency transceiver circuitry may transmit and receive the radio-frequency communications signals with the antenna.

It can be challenging to form satisfactory antenna feed structures in an electronic device. If care is not taken, an antenna feed structure may be difficult to manufacture or may not be reliable.

SUMMARY

An electronic device may have metal structures such as metal electronic device housing structures and other conductive structures. The conductive structures may have a slot or other opening. An antenna may be formed from the conductive structures and opening.

Control circuitry in the electronic device may receive input from input-output devices and may use the input-output devices to provide a user with output. The control circuitry may be coupled to a radio-frequency transceiver. During operation, the control circuitry may use the radio-frequency transceiver to transmit and receive wireless communications.

The radio-frequency transceiver may be coupled to the antenna using a transmission line. The transmission line may have a first end with a radio-frequency connector coupled to a connector on a printed circuit board that includes the radio-frequency transceiver and may have a second end with a radio-frequency connector that is coupled to a radio-frequency connector on an antenna feed bolt.

The antenna feed bolt may have a shaft that spans the opening in the conductive structures. The antenna feed bolt shaft may pass through a through hole in the conductive structures and may be received within an opening such as a recess or through hole in the conductive structures. The antenna feed bolt may be coupled to antenna feed terminals for feeding the antenna.

Threads on the antenna feed bolt may engage threads on the conductive structures. Threads in the radio-frequency connector in the antenna feed bolt may couple to a threaded radio-frequency connector member on the transmission line. In some configurations, threaded bolts that contain antenna tuning circuits may span the opening in the conductive structures.

The conductive structures and the opening in the conductive structures may be configured to form an antenna resonating element for a slot antenna, inverted-F antenna, or other suitable antenna.

DETAILED DESCRIPTION

An electronic device may have conductive housing structures that are used to form antennas. This allows the electronic device to handle wireless communications. In some configurations, the conductive housing structures having slots or other openings. An antenna such as a slot antenna may be formed from a conductive housing structure that has an opening. Radio-frequency transceiver circuitry may be coupled to a slot antenna using a transmission line. The transmission line may have a radio-frequency connector that is coupled to a radio-frequency connector on an antenna feed structure. The antenna feed structure may be an elongated threaded member such as an antenna feed bolt.

Figure 1:
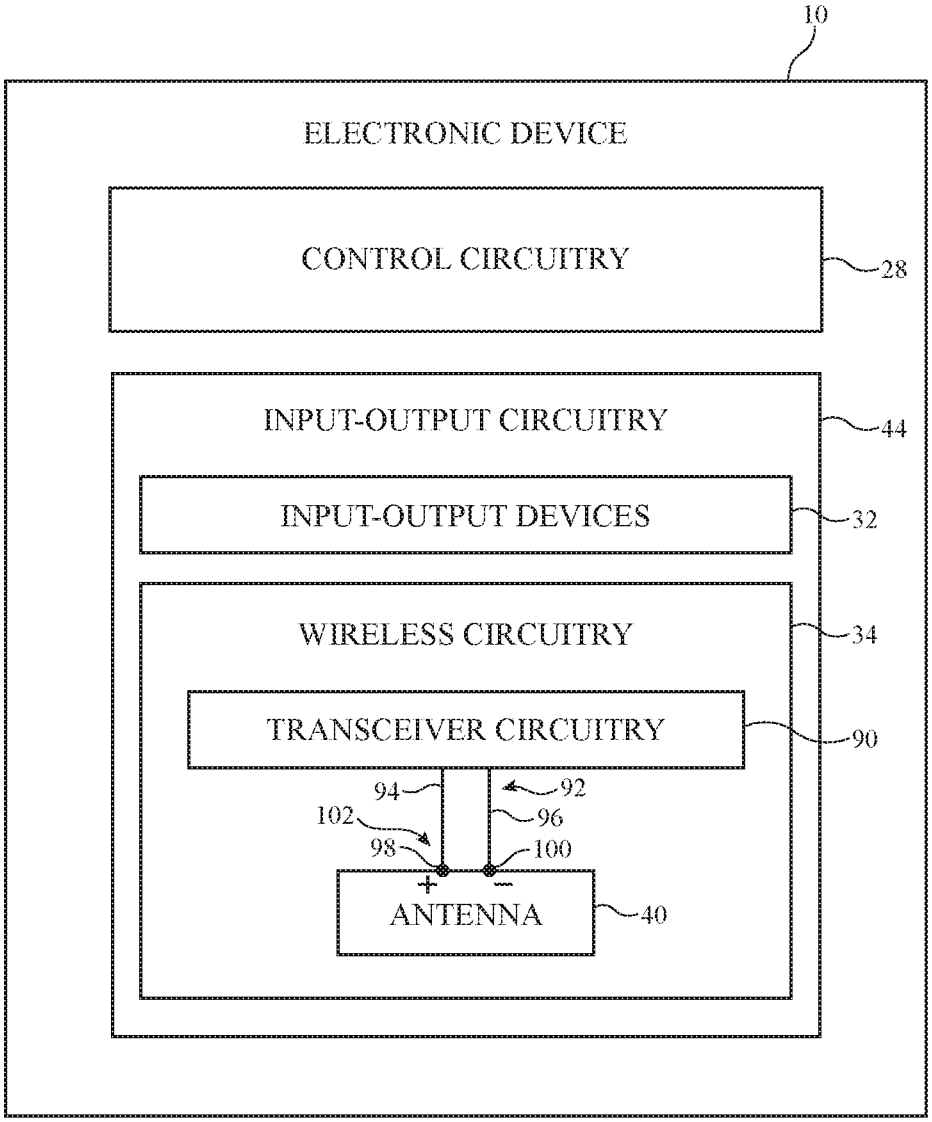
FIG. 1 is a schematic diagram of an illustrative electronic device in accordance with an embodiment.

An electronic device such as electronic device 10 of FIG. 1 may be provided with wireless circuitry having one or more antennas such as slot antennas that are formed from conductive housing structure openings and are fed with antenna feed bolts. The wireless circuitry may include antennas such as wireless local area network antennas or other antennas. Electronic device 10 may be a computing device such as a laptop computer, a desktop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless internet-connected voice-controlled speaker, equipment that implements the functionality of two or more of these devices, or other electronic equipment.

As shown in FIG. 1, device 10 may include storage and processing circuitry such as control circuitry 28. Circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in circuitry 28 may be used to control the operation of device 10. This processing circuitry may be based on one or more microprocessors, microcontrollers, digital signal processors, application specific integrated circuits, etc.

Circuitry 28 may be used to run software on device 10, such as internet browsing applications, voice-over-internet-protocol (VOIP) telephone call applications, email applications, media playback applications, reminder list applications, calendar applications, shopping applications, home automation applications, applications for setting alarms and timers, operating system functions, etc. To support interactions with external equipment, circuitry 28 may be used in implementing communications protocols. Communications protocols that may be implemented using circuitry 28 include internet protocols, wireless local area network protocols (e.g., IEEE 802.11 protocols—sometimes referred to as WiFi®—and protocols for other short-range wireless communications links such as the Bluetooth® protocol), cellular telephone protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch sensors, displays, light-emitting components such as displays without touch sensor capabilities, buttons (mechanical, capacitive, optical, etc.), scrolling wheels, touch pads, key pads, keyboards, microphones, cameras, buttons, speakers, status indicators, audio jacks and other audio port components, digital data port devices, motion sensors (accelerometers, gyroscopes, and/or compasses that detect motion), capacitance sensors, proximity sensors, magnetic sensors, force sensors (e.g., force sensors coupled to a display to detect pressure applied to the display), etc.

Input-output circuitry 44 may include wireless circuitry 34 to support wireless communications. Wireless circuitry 34 may include radio-frequency (RF) transceiver circuitry 90 formed from one or more integrated circuits, power amplifier circuitry, low-noise input amplifiers, passive RF components, one or more antennas such as antenna 40, transmission lines such as transmission line 92, and other circuitry for handling RF wireless signals. Wireless signals can also be sent using light (e.g., using infrared communications).

Radio-frequency transceiver circuitry 90 may include wireless local area network transceiver circuitry to handle 2.4 GHz and 5 GHz bands for WiFi® (IEEE 802.11) wireless local area network communications and may include Bluetooth® circuitry to handle the 2.4 GHz Bluetooth® communications band. If desired, circuitry 90 may handle other bands such as cellular telephone bands, near-field communications bands (e.g., 13.56 MHz), millimeter wave bands (e.g., communications at 60 GHz), and/or other communications bands. Configurations in which radio-frequency transceiver circuitry 90 handles wireless local area network bands (e.g., 2.4 GHz and 5 GHz) may sometimes be described herein as an example. In general, however, circuitry 90 may be configured to cover any suitable communications bands of interest.

Wireless circuitry 34 may include one or more antennas such as antenna 40. Antennas such as antenna 40 may be formed using any suitable antenna types. For example, antennas in device 10 may include antennas with resonating elements that are formed from loop antenna structures, patch antenna structures, inverted-F antenna structures, slot antenna structures, planar inverted-F antenna structures, helical antenna structures, monopole antennas, dipoles, hybrids of these designs, etc. Parasitic elements may be included in antennas 40 to adjust antenna performance. In some configurations, device 10 may have isolation elements between respective antennas 40 to help avoid antenna-to-antenna cross-talk. Different types of antennas may be used for different bands and combinations of bands. For example, one type of antenna may be used in forming a local wireless link antenna and another type of antenna may be used in forming a remote wireless link antenna. In some configurations, different antennas may be used in handling different bands for transceiver circuitry 90. Each antenna 40 may cover one or more bands. For example, antennas 40 may be single band wireless local area network antennas or dual band wireless local area network antennas.

As shown in FIG. 1, radio-frequency transceiver circuitry 90 may be coupled to antenna feed 102 of antenna 40 using transmission line 92. Antenna feed 102 may include a positive antenna feed terminal such as positive antenna feed terminal 98 and may have a ground antenna feed terminal such as ground antenna feed terminal 100. Transmission line 92 may be formed from metal traces on a printed circuit, cables, or other conductive structures and may have a positive transmission line signal path such as path 94 that is coupled to terminal 98 and a ground transmission line signal path such as path 96 that is coupled to terminal 100.

Transmission line paths such as path 92 may be used to route antenna signals within device 10. Transmission lines in device 10 may include coaxial cables, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the paths formed using transmission lines such as transmission line 92 and/or circuits such as these may be incorporated into antenna 40 (e.g., to support antenna tuning, to support operation in desired frequency bands, etc.). During operation, control circuitry 28 may use transceiver circuitry 90 and antenna(s) 40 to transmit and receive data wirelessly. Control circuitry 28 may, for example, receive wireless local area network communications wirelessly using transceiver circuitry 90 and antenna(s) 40 and may transmit wireless local area network communications wirelessly using transceiver circuitry 90 and antenna(s) 40.

Figure 2:
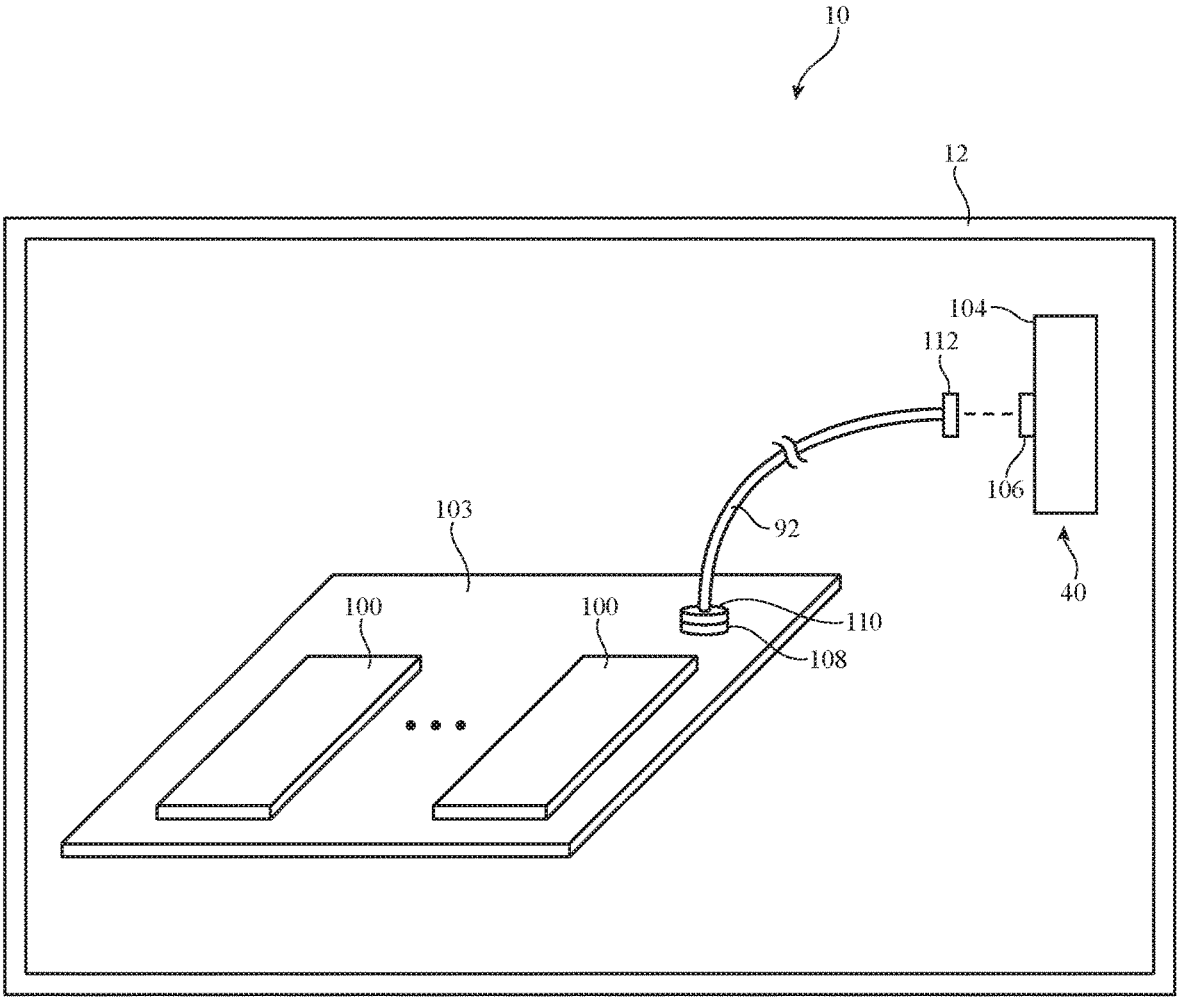
FIG. 2 is a diagram showing how an electronic device may include circuitry that is coupled to an antenna using a transmission line in accordance with an embodiment.

A diagram of an illustrative electronic device such as device 10 of FIG. 1 is shown in FIG. 2. As shown in FIG. 2, device 10 may have a housing such as housing 12. Housing 12, which may sometimes be referred to as an enclosure or case, may be formed of plastic, glass, ceramics, fiber composites, metal (e.g., stainless steel, aluminum, copper, brass, etc.), fabric, other suitable materials, or a combination of any two or more of these materials. Housing 12 may be formed using a unibody configuration in which some or all of housing 12 is machined or molded as a single structure or may be formed using multiple structures (e.g., an internal frame structure covered with one or more outer housing layers). Configurations for housing 12 in which housing 12 includes support structures (a stand, leg(s), handles, etc.) may also be used.

As shown in the example of FIG. 2, components for device 10 may be mounted in housing 12. These components may include for example, components 100 mounted on printed circuits such as printed circuit 103. Printed circuit 103 may be a rigid printed circuit board (e.g., a printed circuit formed from rigid substrate material such as fiberglass-filled epoxy) or may be a flexible printed circuit (e.g., a flex circuit formed from a sheet of polyimide or a layer of other flexible polymer). Components 100 may include, for example, integrated circuits and other circuitry for transceiver circuitry 90 and other wireless circuitry 34. Antenna 40 may be formed from metal housing structures (e.g., outwardly exposed housing walls, legs and other support stand structures, internal and/or external frame members, rear walls, sidewalls, front housing surface structures, metal midplates in handheld devices), and/or may be formed from other conductive structure(s) 104 in device 10. Threaded members such as bolts may be coupled to these conductive structures as shown by illustrative bolt 106. Bolts such as bolt 106 may form antenna feeds and/or antenna tuning components for antenna(s) 40 and may therefore sometimes be referred to as antenna feed bolts and/or antenna tuning bolts.

A coaxial cable such as transmission line 92 of FIG. 2 may be used in coupling the circuitry of printed circuit 103 (e.g., transceiver circuitry 90) to antenna 40. Transmission line 92 may have opposing first and second ends. The first end of the cable may have a first radio-frequency cable connector such as first connector 110. The opposing second end of the cable may have a second radio-frequency cable connector such as second connector 112. First connector 110 may be configured to mate with a radio-frequency connector such as printed circuit connector 108 on printed circuit 103 (e.g., a connector that is soldered to metal traces in the circuitry of printed circuit 103). Second connector 112 may be configured to mate with a corresponding radio-frequency connector that is coupled to and/or forms a part of bolt 106. Connectors such as connector 108, connector 110, connector 112, and the connector of bolt 106 may be any suitable radio-frequency connectors such as MCX (micro coaxial connector) connectors, other coaxial connectors such as connectors that attach with clips, stab-in connectors, SMA (subminiature version A) connectors, etc. The use of threaded radio-frequency cable connectors such as MCX connectors for forming connectors 108, 110, 112, and the connector of bolt 106 is illustrative.

As shown in FIG. 2, connector 110 mates with connector 108 to couple transmission line 92 to printed circuit 103 and transceiver circuitry 90 and other electrical components 100 on printed circuit 103. Connector 112 mates with the connector of bolt 106 to couple transmission line 92 to antenna 40. If desired, circuitry in components 100 and/or circuitry associated with structures 104 may include antenna tuning circuits, impedance matching circuitry, switches, impedance monitoring circuits, filters, and/or other radio-frequency circuitry. This circuitry may, if desired, be interposed between transceiver circuitry 90 and transmission line 92 and/or between transmission line 92 and antenna 40. Configurations in which transmission line 92 is formed from one or more linked transmission line segments with intervening blocks of tuning circuitry, impedance matching circuitry, switches, impedance monitoring circuitry, filters, and/or other radio-frequency circuitry may also be used.

Antennas in device 10 such as illustrative antenna 40 of FIG. 2 may be formed using any suitable type of antenna (e.g., slot antennas, inverted-F antennas, patch antennas, monopole antennas, dipole antennas, Yagi antennas, planar inverted-F antennas, loop antennas, other antennas, hybrid antennas that are formed from antenna resonating elements of different types, etc.). These antennas may include, for example, one or more antennas such as single-band or dual-band antennas for supporting wireless local area network (WiFi®) communications and/or other wireless communications. For example, device 10 may include a first antenna or set of antennas for handling 2.4 GHz wireless local area network communications and a second antenna or set of antennas for handling 5 GHz wireless local area network communications. With one illustrative configuration, device 10 contains one or more slot antennas and/or other antennas with conductive structures that are separated by a gap (e.g., a closed slot that is encircled by conductive structures and/or an open slot that has a closed end and an opposing open end that is not covered with conductive structures).

Figure 3:
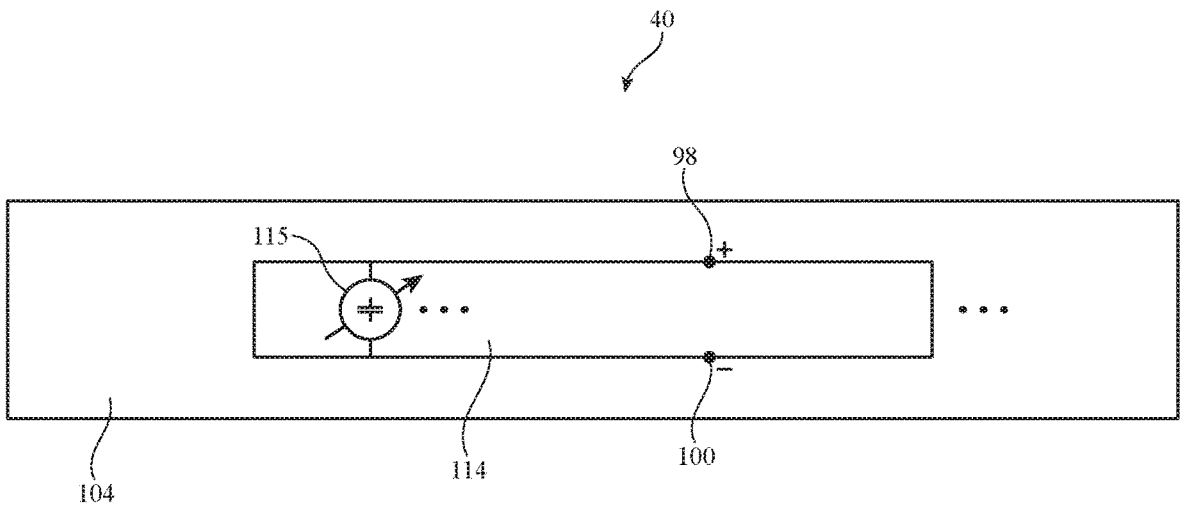
FIG. 3 is a cross-sectional side view of an illustrative antenna in accordance with an embodiment.

An illustrative slot antenna configuration for antenna 40 is shown in FIG. 3. As shown in FIG. 3, conductive structures 104 may have one or more openings such as opening 114 that are fully and/or partially filled with a gaseous dielectric such as air and/or a solid dielectric such as polymer, glass, ceramic, and/or other solid insulating material. Transmission line 92 may have a positive signal line path such as path 94 of FIG. 1 that is coupled (via positive signal conductive structures in connectors 104 and the connector of bolt 106) to positive antenna feed terminal 98. Transmission line 92 may also have a ground (negative) signal line path such as path 96 of FIG. 1 that is coupled (via ground structures in connectors 104 and the connector of bolt 106) to ground antenna feed terminal 100. Antenna feed terminals 98 and 100 may be coupled to respective portions of conductive structures 104 on opposing sides of opening 114 (e.g., a slot or other gap in structures 104 that is filled with gaseous and/or solid dielectric).

In some configurations, conductive structures 104 may have an elongated shape (e.g., the shape of a rectangular bar or cylindrical rod). In these configurations and other configurations for conductive structures 104, multiple openings 114 (e.g., elongated openings such as rectangular slots, oval slots, rectangular slots with rounded corners, etc.) may be formed at two or more respective positions along the length of the conductive structures (e.g., at multiple locations along the length of a metal bar or rod).

Optional tuning components may be coupled to antenna 40. As an example, one or more antenna tuning components such as illustrative component 115 of FIG. 3 may bridge opening 114. Component 115 may be, for example, a tunable capacitor, a tunable inductor, a tunable component formed from a series of discrete components that can be selectively switched into or out of use with corresponding switching circuitry (e.g., a multiplexer coupled to a set of capacitors or a set of inductors to form, respectively, a tunable capacitor or tunable inductor), etc. Component 115 may have a first terminal coupled to conductive structures 104 on a first side of opening 114 and a second terminal coupled to conductive structures 104 on an opposing second side of opening 114 or may otherwise be coupled to conductive portions of antenna 40 and/or the circuitry associated with antenna 40 (e.g., matching circuits, etc.). In some configurations, component 115 may be formed in an elongated threaded member such as a bolt (sometimes referred to as an antenna tuning circuit bolt). Antenna tuning circuit bolts and elongated threaded members forming antenna feeds such as bolt 106 (FIG. 2) may have positive and ground portions (terminals) that couple to conductive structures 104 on opposing sides of opening 114 and/or that are otherwise mounted to structures 104.

Figure 4:
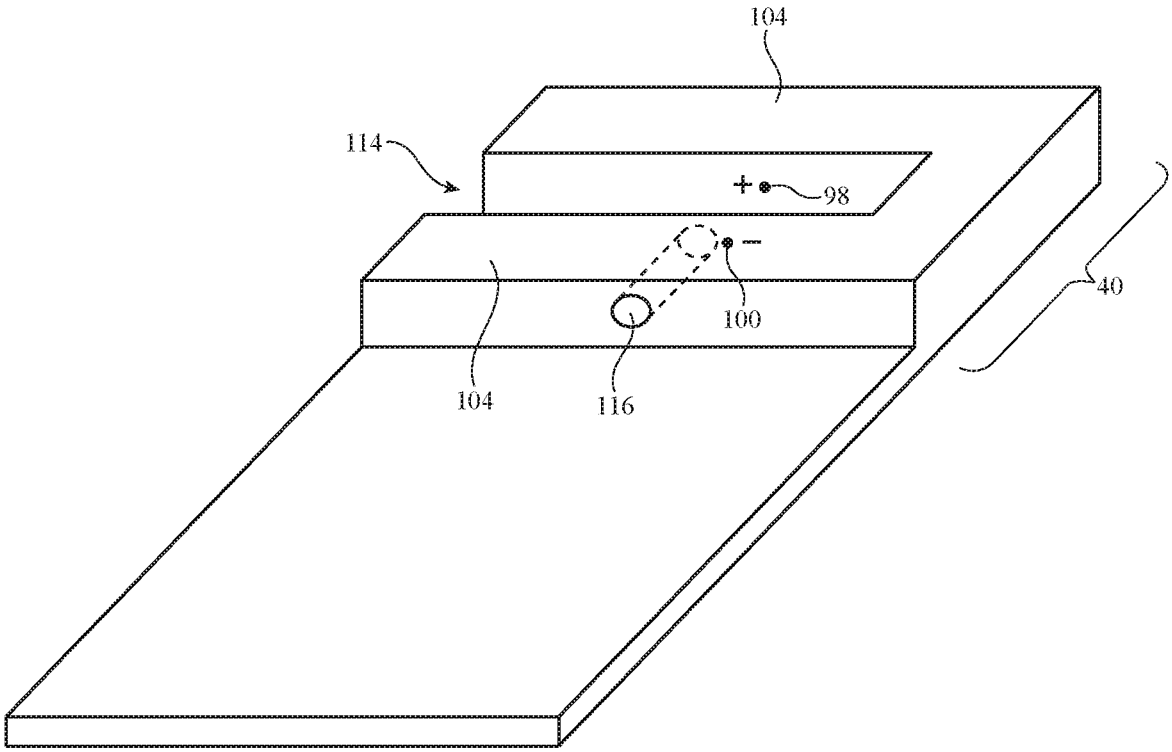
FIG. 4 is a perspective view of illustrative electronic device antenna structures of the type that may be fed using an antenna feed in accordance with an embodiment.

Consider, as an example, the antenna arrangement of FIG. 4. In the example of FIG. 4, conductive structures 104 form part of the interior and/or exterior of electronic device 10. (Other portions of device 10 such as display structures, battery structures, buttons, cosmetic covering portions, etc. are not shown in FIG. 4 to avoid obscuring conductive structures 104.) As shown in FIG. 4, conductive structures 104 may have portions on opposing sides of opening 114. Opening 116 may be formed from a through hole in structures 104 on one side of opening 114. Opening 116 may be threaded (e.g., in configurations in which the portion of the shaft of bolt 106 in opening 116 is threaded) or may be unthreaded (e.g., in configuration in which an opening in structures 104 on the opposing side of opening 114 has a threaded portion that receive a threaded tip portion of bolt 106). When bolt 106 is mounted in opening 116, bolt 106 may be used to feed antenna 40 and couple antenna 40 to transmission line 92. Bolt 106 may have a central conductor surrounded by a cylindrical conductive layer and may therefore sometimes be referred to as a coaxial bolt or coaxial threaded member. Antenna 40 may be a slot antenna, an inverted-F antenna, a hybrid slot-inverted-F antenna, and/or other suitable antenna.

Figure 5:
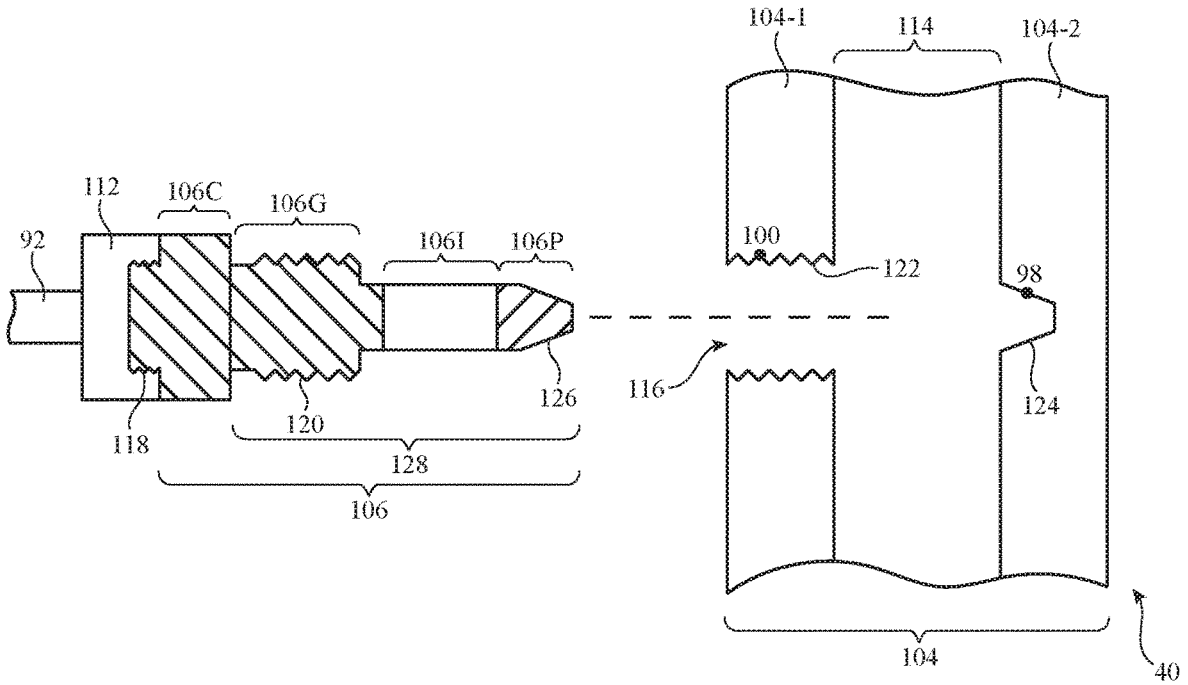
FIG. 5 is a cross-sectional side view of an illustrative antenna feed bolt with an unthreaded shaft tip in accordance with an embodiment.

FIG. 5 is a cross-sectional side view of bolt 106 and associated conductive structures 104. Bolt 106 may be pigtailed to transmission line 92 (e.g., a coaxial cable) or bolt 106 may have a radio-frequency connector such as connector 106C that mates with connector 112 (e.g., using threads 118 on connector 106C and on connector 112 or using other coupling mechanisms). Bolt 106 may have a first terminal such as terminal 106P (e.g., a positive antenna signal terminal coupled to positive path 94 of transmission line 92) and a second terminal such as terminal 106G (e.g., a ground terminal coupled to a ground path 96 in transmission line 92). Shaft 128 of bolt 106 may have a tapered tip 126 that is configured to be received within an opening such as a recessed portion 124 of conductive structure portion 104-2, thereby forming positive antenna feed terminal 98. Insulating portion 1061 may separate terminal 106P from terminal 106G on shaft 128. The portion of shaft 128 that forms terminal 106G may have threads 120 that are configured to mate with corresponding threads 122 in opening 116 of portion 104-1 of conductive structures 104, thereby forming ground antenna feed terminal 100.

Figure 6:
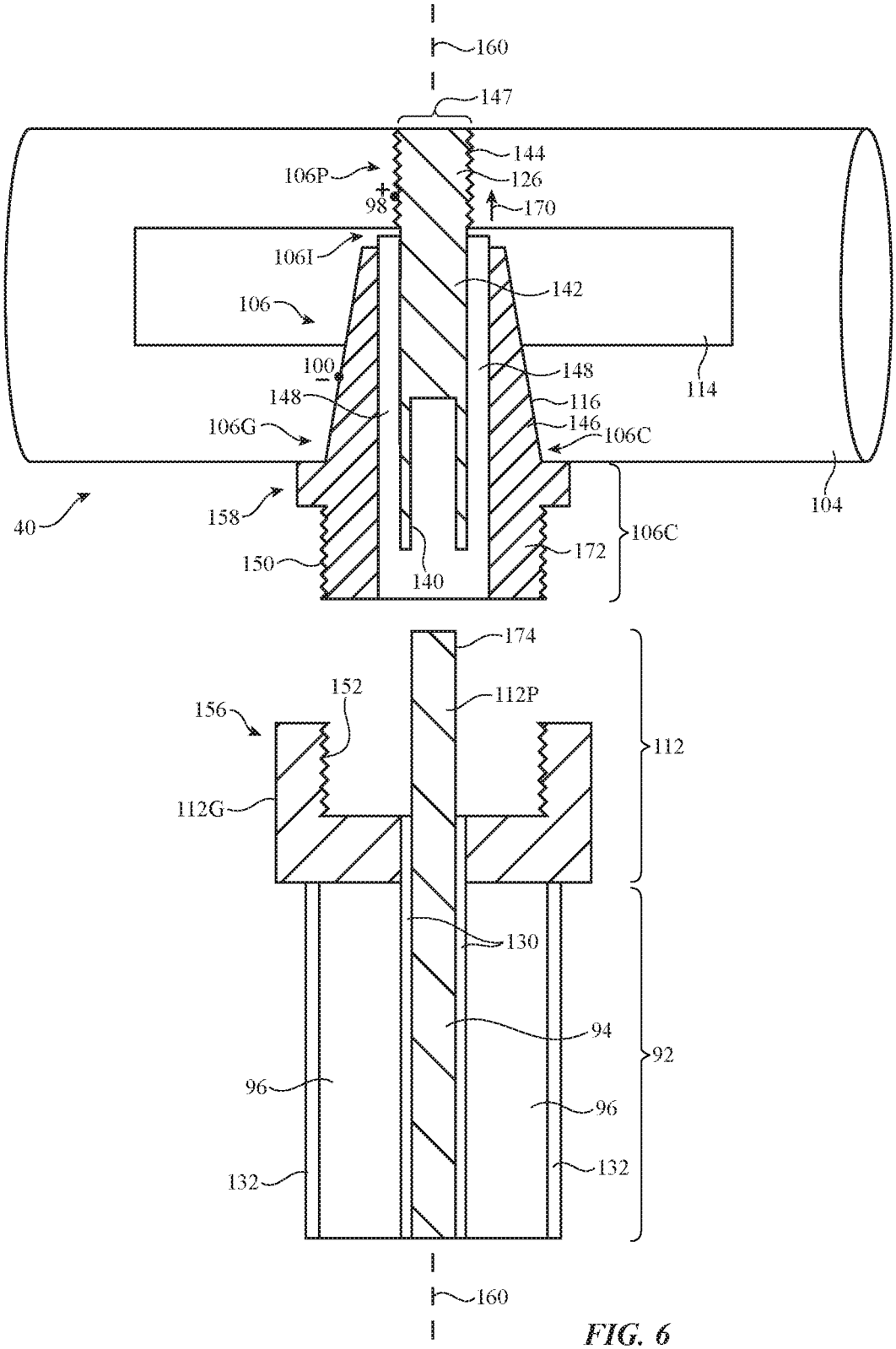
FIG. 6 is a cross-sectional side view of an illustrative antenna feed bolt with a threaded shaft tip in accordance with an embodiment.

A cross-sectional side view of another illustrative configuration for an elongated threaded antenna feed member such as antenna feed bolt 106 is shown in FIG. 6. In the example of FIG. 6, conductive structures 104 have the shape of a metal rod with a rectangular through hole that forms opening 114 for slot antenna 40. Transmission line 92 may be a coaxial cable (as an example). Transmission line 92 of FIG. 6 has an insulating layer 130 that surrounds a wire or other central conductive member forming positive signal path 94. Insulating layer 130 is surrounded by a metal layer (e.g., a braided wire layer, metal foil, etc.) forming ground signal path 96. Outer insulator layer 132 insulates ground path 96. Ground path 96 is shorted to metal ground connector member 112G in connector 112. Connector member 112G may have an outer surface such as surface 156 with a hexagonal outline when viewed along longitudinal axis 160 or other shape with flat side surfaces. Member 112G may have an inner surface with threads 152 that mate with corresponding threads 150 on the outer surface of connector 106C in bolt 106. Tip 126 of the shaft of bolt 106 (e.g., in terminal 106P) may have threads 144 that mate with corresponding threads 144 on the inner surface of opening 147 in conductive structures 104. Opening 147 may be a through hole or other opening. Connector 106C may have outer surfaces 158 with flat portions (e.g., surfaces 158 may form a hexagonal outline when viewed along longitudinal axis 160 of bolt 106) to allow bolt 106 to be gripped by a wrench or other tool when being screwed into conductive structures 104.

When rotating bolt 106 (e.g., using a wrench to screw bolt 106 into place in opening 116), the threads on tip 126 of bolt 106 will engage with the corresponding threads in structures 104, thereby pulling bolt 106 in direction 170. This pulls the tapered surfaces of portion 146 of bolt 106 into contact with the inner surfaces of through hole opening 116 in structures 104. In this way, positive signal tip 126 makes contact with conductive structures 104 to short terminal 106P to antenna 40 and thereby form antenna feed terminal 98, while ground signal portion 146 of the shaft of bolt 106 makes contact with conductive structures 104 to short terminal 106G of bolt 106 to antenna 40 and thereby form antenna feed terminal 100.

When connector 112 mates to connector 106C, threaded ground member 112G of connector 112 is mechanically and electrically coupled to threaded ground portion 172 of connector 106C. Protruding portion 174 of positive signal conductor 94 (which forms positive path portion 112P of connector 112) mates with corresponding portion 140 on positive signal path structure 142 (e.g., a metal core member) of bolt 106. In this configuration, positive path 94 of transmission line 92 is coupled to positive antenna feed terminal 98 through bolt 106 and ground path 96 of transmission line 92 is coupled to ground antenna feed terminal 100 through bolt 106. Dielectric 148 (e.g., plastic, etc.) may surround portions of positive signal path structure 142 to insulate portion 146 of bolt 106 from member 142.

Figure 7:
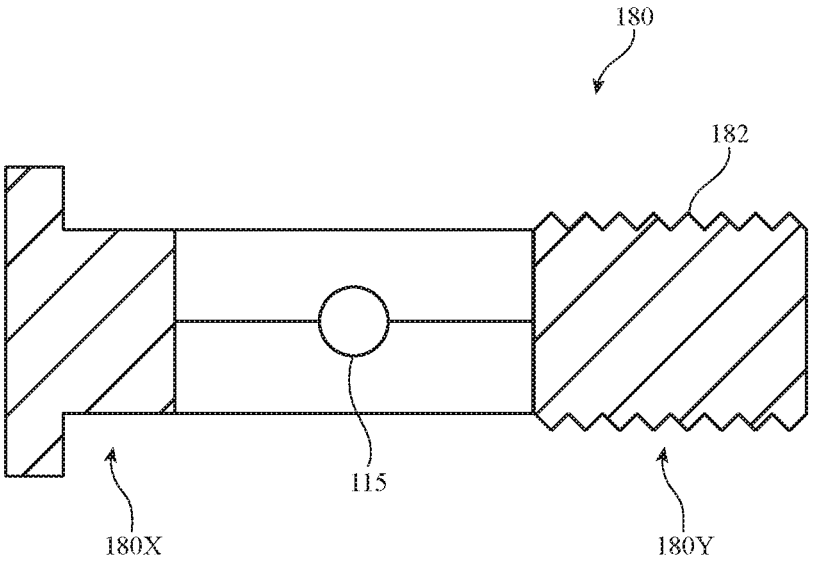
FIG. 7 is a cross-sectional side view of an illustrative antenna tuning bolt with a threaded shaft tip in accordance with an embodiment.
Figure 8:
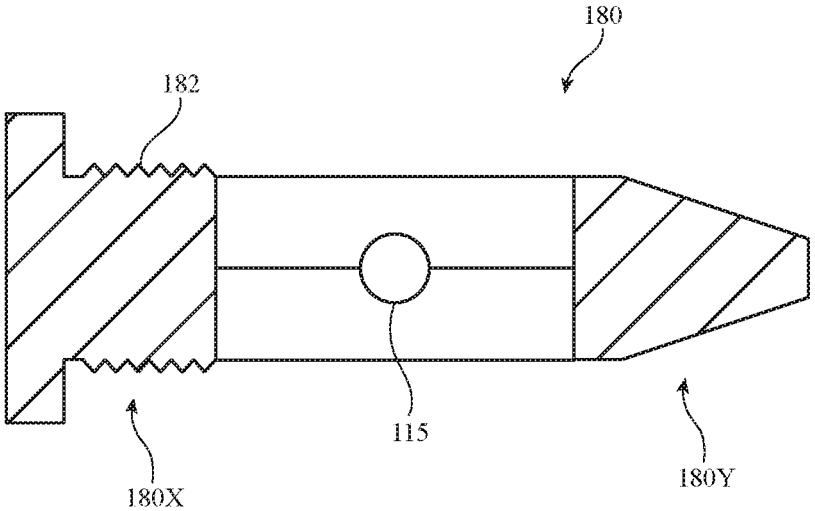
FIG. 8 is a cross-sectional side view of an illustrative antenna tuning bolt with an unthreaded tapered shaft tip in accordance with an embodiment.

If desired, adjustable components such as adjustable component 115 of FIG. 3 may be formed in an elongated threaded member, as shown by antenna tuning bolts 180 of FIGS. 7 and 8. Bolts 180 may each have a first terminal 180X at one end and a second terminal 180Y at an opposing second end. Component 115 may be formed from fixed and/or electrically adjustable circuitry (capacitors, inductors, switches, etc.) that is mounted within bolt 180. Component 115 may be fixed (e.g., a fixed capacitor or inductor for antenna tuning) or may be electrically adjusted by control signals from control circuitry 28 (e.g., an adjustable capacitor circuit, an adjustable inductor circuit, etc.). In the example of FIG. 7, threads 182 are formed on the tip of the shaft of bolt 180 and form part of terminal 180Y. In the example of FIG. 8, threads 182 are formed on the end of shaft adjacent to bolt head 184 and form part of terminal 180X. When mounted to conductive structures 104 as shown in FIG. 3, terminal 180X may be shorted to conductive structures 104 on one side of opening 114 and terminal 180Y may be shorted to conductive structures 104 on an opposing side of opening 114. Antenna tuning bolts such as bolts 180 of FIGS. 7 and 8 may have hexagonal heads, square heads, or heads with other shapes (e.g., with flat sides) that facilitate engagement with a tool such as a wrench.

During assembly, antenna tuning bolts 180 and antenna feed bolts such as antenna feed bolt 106 may be attached to conductive structures 104 (e.g., at a first manufacturing facility). Later (e.g., at the same manufacturing facility or at a second manufacturing facility as part of a final assembly operation), transmission lines such as transmission line 92 (e.g., coaxial cables) can be coupled to the connector of bolt 106. This approach may help simplify manufacturing operations in forming device 10 and may enhance reliability.

The foregoing is merely illustrative and various modifications can be made to the described embodiments. The foregoing embodiments may be implemented individually or in any combination.

What is claimed is:

1. An electronic device antenna that is configured to couple to a transmission line having first and second signal paths, comprising:

conductive structures having a first portion with a first antenna feed terminal and a second portion with a second antenna feed terminal, wherein the conductive structures have an opening between the first and second portions; and an antenna feed bolt that is coupled to the transmission line, that has a first bolt terminal shorted to the first portion that couples the first signal path in the transmission line to the first antenna feed terminal and that has a second bolt terminal that couples the second signal path in the transmission line to the second antenna feed terminal.

2. The electronic device antenna defined in claim 1 wherein the antenna feed bolt has a shaft that bridges the opening, wherein the first portion has a through hole opening through which the shaft passes, and wherein the second portion has a recess that receives a tip of the shaft.

3. The electronic device antenna defined in claim 2 wherein the first bolt terminal is formed from a threaded portion of the shaft.

4. The electronic device antenna defined in claim 3 wherein the second bolt terminal is formed from an unthreaded tapered portion of the tip of the shaft.

5. The electronic device antenna defined in claim 2 wherein the antenna feed bolt has a shaft and wherein the first and second portions have respective first and second holes that receive the shaft.

6. The electronic device antenna defined in claim 5 wherein the second bolt terminal is formed from a threaded tip portion of the shaft that is received in the second hole.

7. The electronic device antenna defined in claim 6 wherein the first bolt terminal is formed from a tapered unthreaded portion of the shaft that is received in the first hole.

8. The electronic device antenna defined in claim 1 wherein the antenna feed bolt has a first radio-frequency connector that is configured to mate with a second radio-frequency connector at an end of the transmission line.

9. The electronic device antenna defined in claim 8 wherein the transmission line is a coaxial cable and wherein the first radio-frequency connector is a radio-frequency coaxial cable connector.

10. The electronic device antenna defined in claim 1 wherein the antenna feed bolt has a shaft with a threaded tip that is configured to screw into a corresponding threaded opening in the second portion of the conductive structures.

11. The electronic device antenna defined in claim 10 wherein the conductive structures and the opening form a slot antenna resonating element that is fed by the first and second antenna feed terminals.

12. The electronic device defined in claim 1 wherein the conductive structures comprise metal electronic device housing structures.

13. The electronic device defined in claim 12 wherein the conductive structures and the opening are configured to form a slot antenna resonating element operable in a wireless local area network communications band.

14. An antenna, comprising:

a first metal structure;

a second metal structure separated from the first metal structure by an opening;

a bolt that is coupled across the opening between the first and second metal structures; and a circuit component in the bolt that is configured to tune the antenna.

15. The antenna defined in claim 14 wherein the bolt has a shaft with threads, wherein the first metal structure has a through hole that receives the shaft, and wherein the second metal structure has threads that engage the threads on the shaft.

16. The antenna defined in claim 15 wherein the bolt has a first terminal formed from an unthreaded portion of the shaft in the through hole and has a second terminal formed from the threads on the shaft and wherein the circuit component is coupled between the first and second terminals.

17. The antenna defined in claim 14 wherein the bolt has a shaft with threads that form a first terminal, wherein the first metal structure has a through hole with threads that engage the threads of the shaft and short the first metal structure to the first terminal, and wherein the second metal structure contacts an unthreaded portion of the shaft that forms a second terminal to short the second metal structure to the second terminal.

18. The antenna defined in claim 14 wherein the first and second metal structures comprise respective first and second metal electronic device housing structures, the antenna further comprising an antenna feed bolt having portions shorted to a first antenna feed terminal on the first metal electronic device housing structure and a second antenna feed terminal on the second metal electronic device housing structure.

19. An electronic device, comprising:

input-output circuitry;

control circuitry coupled to the input-output circuitry;

conductive electronic device housing structures that include an opening that separates a first portion of the conductive electronic device housing structures from a second portion of the electronic device housing structures to form an antenna from the conductive electronic device housing structures;

an antenna feed member coupled across the opening, wherein the antenna feed member has a first surface that is shorted to the first portion to form a ground antenna feed terminal and has a second surface that is shorted to the second portion to form a positive antenna feed terminal and wherein at least one of the first or second surfaces has threads;

radio-frequency transceiver circuitry that the control circuitry is configured to use to transmit and receive wireless communications; and a transmission line coupled between the radio-frequency transceiver circuitry and the antenna feed member.

20. The electronic device defined in claim 19 wherein the transmission line comprises a coaxial cable having a first radio-frequency connector, wherein the antenna feed member has a second radio-frequency connector, and wherein the first and second radio-frequency connectors have mating threads.

* * * * *